United States Patent [19]

Meindl

[11] Patent Number: 4,942,823

[45] Date of Patent: Jul. 24, 1990

[54] CABLE CONVEYANCE

[75] Inventor: Bernd Meindl, Hard, Austria

[73] Assignee: Konrad Doppelmayr & Sohn Maschinenfabrik Gesellschaft m.b.H. & Co. KG, Wolfurt, Austria

[21] Appl. No.: 389,425

[22] Filed: Aug. 3, 1989

[30] Foreign Application Priority Data

Aug. 18, 1988 [AT] Austria ..... 2049/88

[51] Int. Cl.[5] ..... B61B 7/00

[52] U.S. Cl. ..... 104/178; 198/322

[58] Field of Search ..... 104/89, 112, 117.1, 104/168, 173.1, 173.2, 178; 198/468.4, 322

[56] References Cited

U.S. PATENT DOCUMENTS 4,744,306 5/1988 Kunczynski ..... 104/173.1

*Primary Examiner*—Andres Kashnikow

*Attorney, Agent, or Firm*—Herbert Dubno

[57] ABSTRACT

A cable conveyance has devices for decoupling the passenger carriers from the cable at an upstream side of a station, a device for recoupling the carriers to the cable at a downstream side of the station and a path of the carriers through the station after the carriers have been decoupled from the cable. This path is formed by a roll in which the carriers are guided and includes decelerating and accelerating stretches in which respective driven rollers engage the carriers. At a control stretch the speed of the carriers can be adjusted relative to a normal speed in response to a sensor of the intercarrier interval to maintain a predetermined carrier spacing on recoupling of the carriers to the cable.

8 Claims, 4 Drawing Sheets

CABLE CONVEYANCE

FIELD OF THE INVENTION

My present invention relates to a cable conveyance and, more particularly, a cable car, chair lift, gondola lift or other cable conveyance, generally traveling between at least one station at a higher elevation and at least one station at a lower elevation and from which transporters for passengers are suspended at spaced-apart locations.

BACKGROUND OF THE INVENTION

Cable conveyances for transporting people between a station at a relatively high altitude and a station at a lower altitude, e.g. between a hill or mountain station and a station at a lower point, e.g. in a valley, are widely used, for example, at ski slopes and in areas in which the transport of people to a mountain peak, for example, may prove to be advantageous or desirable.

Such cable conveyances generally comprise a transport cable extending endlessly around pulleys or wheels at the upper and lower station, and a plurality of passenger-carrying vehicles which are suspended at spaced locations from the cable.

The "vehicles" or passenger carriers may be of diverse types. For example, they may be cabins, gondolas or cars, capable of carrying a plurality of people. They may be individual seats or chairs capable of carrying one or two passengers or they may simply be T-bars which entrain the carried individuals up a ski slope. For the purposes of this description, the devices which support the people to be transported will be referred to simply as carriers and the mechanisms by which they are held on the cable as suspension devices.

In more general terms, therefore, a cable conveyance can have a mountain station and a valley station, each of which is provided with a wheel or pulley about which the transport cable passes, at least one of these wheels being driven and a plurality of carriers such as cabins or seats having respective suspension devices enabling the carrier to be coupled to the cable and to be decoupled from the cable.

At least one of the stations is provided with a mechanism for decoupling the suspension devices from the cable, for displacing the carrier decoupled from the transport cable in a movement direction corresponding to the direction of travel of the transport cable and for recoupling the carrier to the transport cable. The displacement mechanism for the carrier after it has been decoupled from the cable and before it is recoupled to the cable is intended to reduce the speed of the carrier after decoupling so that passengers can leave the carrier and passengers can mount the carrier, and for accelerating the carrier to the speed of the cable for recoupling.

At the stations of a cable conveyance with carriers which can be decoupled from and recoupled to the cable, such as gondolas or seats, the decoupled carriers must be or should be recoupled to the cable with a uniform spacing.

Generally the spacing is established at the valley station. For this purpose, a displacement mechanism is provided which guides the carriers on a rail outwardly of the pulley or wheel about which the cable passes so that the carriers move along this rail with a uniform spacing from one another.

The carriers suspended from the transport cable are thus decoupled from the cable in the latter station and guided away form the cable on this guide rail. Usually the guide rail is provided with a displacement chain which engages the carriers in the region in which decoupling from the cable is effected, and in the region in which the carrier is recoupled to the cable.

After recoupling of the carrier from the cable, the carrier may be displaced by a plurality of rollers which are driven with peripheral speeds decreasing in the direction of displacement of the carrier so that the speed of the carrier is reduced from the speed of the cable to such a speed that passengers can safely leave the carrier or mount the carrier.

Immediately upstream of the recoupled region, these rollers are driven with progressively increasing peripheral speed so that the speed of the carriers can be increased to the speed of the cable and the carrier speed so matched with the cable speed that the carrier can be effectively recoupled to the cable.

The displacement of the carriers in their decoupled state is effected, as noted, for a chain which can be provided at spacings of 4 to 5 meters with projecting fingers engaging the carriers and moving them along with this predetermined spacing.

To the extent that an oncoming carrier has a different spacing from the preceding carrier, i.e. a spacing less than this predetermined distance at which the carriers are to be recoupled to the cable, the spacing of the carriers before recoupling is corrected by this chain since each carrier is brought to the recoupling region only when it has been engaged by one of the projecting fingers of the displacement chain.

However, should the spacing of the oncoming carriers be greater than the predetermined normal distance, the spacing cannot be corrected by the displacement chain in this manner.

Since nonuniform spacings must be avoided in all cases, it has been suggested to retard the cable in the latter instance. However, the complexity involved in retarding the cable, the costs of the equipment for this purpose and the irregular operation of the cable conveyance which results, all are disadvantageous.

In systems using a displacement chain, moreover, problems are frequently encountered because the fingers can swing out of the path of engagement with the carriers in certain operating conditions so that a finger may not always reliably engage a finger. Since it is desirable to operate the cable and the displacement chain at substantially constant speed, it should be evident that considerable difficulty will be encountered because of the problem that the system described is not adequately able to reduce excessive spacings between carriers should such spacings develop.

OBJECTS OF THE INVENTION

It is the principal object of the present invention to provide an improved cable conveyance of the type described which will avoid these drawbacks and, more specifically, ensure a uniform spacing of the carriers both in the case of an excessively narrow spacing and an excessively wide spacing of the oncoming carriers.

In more general terms, it is an object of the invention to provide a cable conveyance which can be operated with greater reliability and uniformity and, particularly, with uniform spacing of the carriers.

Another object of the invention is to provide a cable conveyance wherein, in the region between decoupling of the carriers from the transport cable and the recoupling of the carriers on the transport cable, individual control of the movement of the carriers is possible to enable the carriers to be recoupled to the cable with a uniform spacing apart.

SUMMARY OF THE INVENTION

These objects and others which will become apparent herein-after are attained, in accordance with the present invention by providing in the region of the carrier-displacement mechanism operating on the carriers decoupled from the cable, a measuring device responsive to movement of the carriers and which is connected to a drive in the carrier-conveying means enabling the latter to vary its speed so that the speed of a carrier upon which the mechanism operates is increased or decreased with respect to a normal or predetermined speed. The drive of the mechanism in the decelerating or accelerating stretch of the path of the carriers can thus be controlled in response to the measuring device or sensor According to a feature of the invention, the transport mechanism is provided between the decelerating stretch and the accelerating stretch with a control stretch having a drive engageable with the carrier and which is controllable in response to the sensor. Advantageously, the sensor is provided at the end of a decelerating stretch of this mechanism.

The sensor determines the time interval between passes of successive carriers, i.e. a measure of the spacing between them, and so controls the drive of the mechanism that the carriers are displaced to the recoupling region with the requisite and predetermined spacing.

According to another feature of the invention, the decelerating stretch and the accelerating stretch of the conveying mechanism for the carriers decoupled from the cable are formed with rollers or wheels engaging the carriers as they are guided in the rail and thus which control the speed of the carriers as they travel along the rail. The control stretch between the decelerating and accelerating stretches can also be provided with wheels whose drive can be controllable and for this purpose any drive train of the wheels of the control stretch and transmission can be disposed through which the speed is controlled in response to an output signal from the sensor. Means can be provided for coupling all of the wheels of the control stretch for joint rotation and the transmission can be provided with means for driving these wheels and which can tap the driving impetus from the transmission for the wheels of the decelerating or accelerating stretches or vice versa.

The wheels of the control stretch are thus driven for the requisite time span with either reduced or increased peripheral speed to effect either a deceleration or acceleration of the carrier engaged thereby. However, in the control stretch, wheels engageable with the carriers can be provided in groups so that the wheels of each group can be either accelerated or decelerated with respect to normal speed for displacing a respective carrier for that purpose.

The wheels of the individual groups can be provided with means coupling them together for joint rotation and the drives for the particular group can be tapped from the transmission or drive chain of the wheels of the decelerating stretch or the wheels of the accelerating stretch. The transmissions can include output shafts driven at different speeds and clutches which can be selectively actuated to render one or another of these shafts effective.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
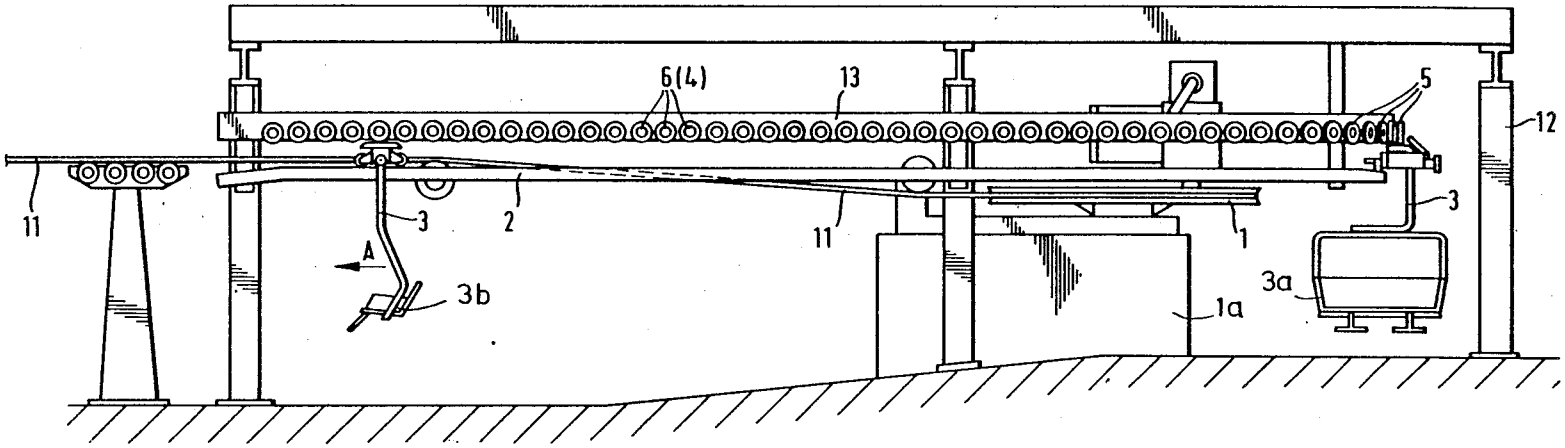
FIG. 1 is a side elevational view in highly diagrammatic form of one of the stations of a cable conveyance according to the invention.

FIG. 1 shows a station of a cable conveyance at which passengers are to depart or mount the carriers of the conveyance.

As can be seen from this Figure, the cable conveyance can comprise a cable disk or pulley 1 around which the transport cable 11 can pass. It will be understood that this cable, supported by the usual pylons, can extend from this station to a mountain station or, if the station shown is a mountain station, from it to the valley station and that both stations may be identical except that only one need be provided with the motor driving the cable disk 1.

The station is provided, in addition, with a guide rail 2 along which carriers 3, upon being decoupled from the cable 11, can be guided by a conveying mechanism which will be described in greater detail. As can be seen from FIG. 1, the carriers 3 may be gondolas 3*a* or chairs 3*b*, both being typical of the conveyances which are carried by the cable and are used to transport people between the stations.

The conveying mechanism for advancing the carriers 3 when they are decoupled from the cable 11 can include wheels 4 serving primarily to decelerate the carriers from the cable speed to a speed at which passengers can dismount from the conveyance, wheels 5 serving primarily to control the speed of the carriers and their spacing as they will be described and for transporting the carriers to the acceleration stretch and wheels 6 serving primarily to accelerate the carriers to the speed of the cable and enabling, therefore, the carrier speed to match the cable speed at the time that each carrier is recoupled to the cable.

The cable disk 1 can be driven by means of a motor not shown in any detail but provided, for example, in a motor housing 1*a*.

The components at this station are carried by a support structure or framework represented generally at 12. The wheels 4, 5 and 6 are, in turn, journaled on a wheel support bar 13 affixed to the framework 12 via the brackets 13*a* of which one can be seen in FIG. 2.

The carriers 3 are suspended at spaced-apart locations on the cable 11 and, as the carriers 3 are entrained by the cable 11 into the station, they are decoupled from the cable and are moved by means of the wheels 4, 5, 6 along the rail 2. In general, this movement is so controlled that the carriers 3 after decoupling from the cable 11 are so sharply decelerated that passengers can dismount or that passengers can mount the carriers before the carriers are accelerated again to the speed of the cable 11 at which the carriers are recoupled to the cable.

Figure 2:
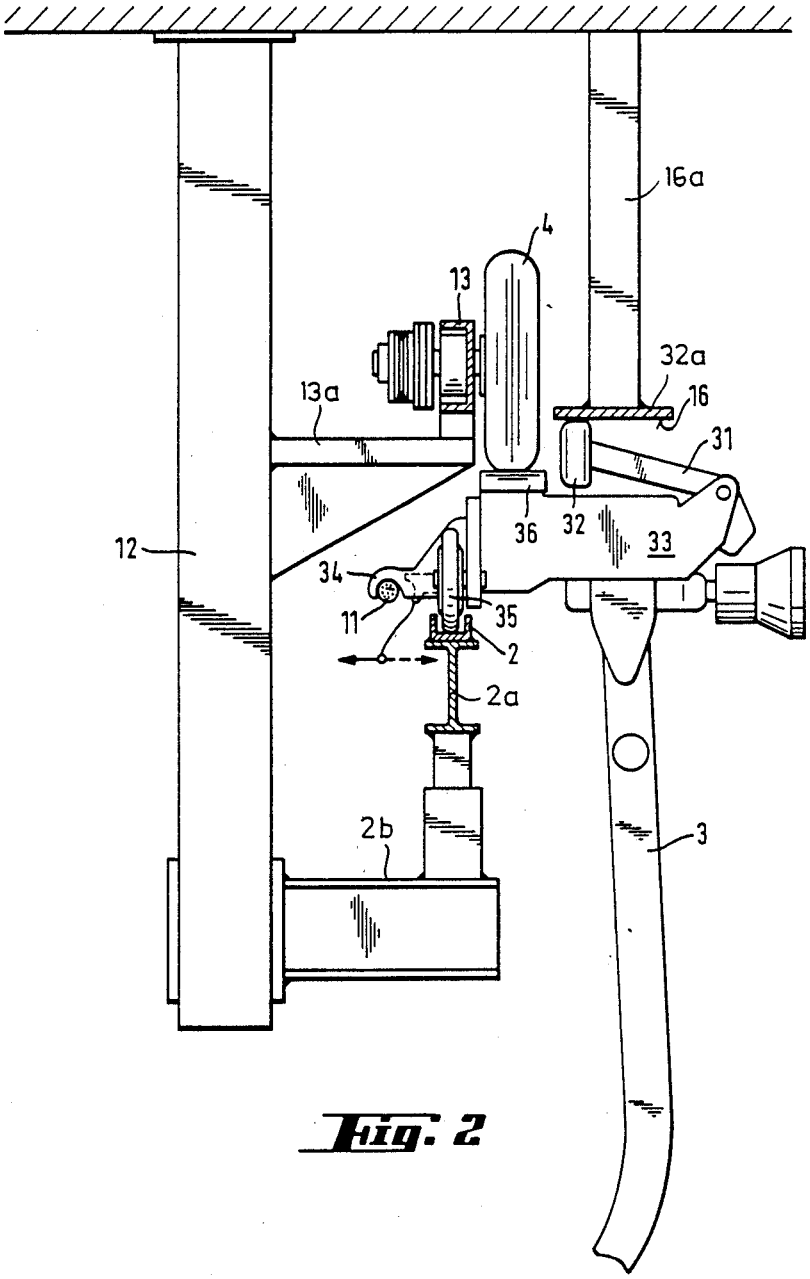
FIG. 2 is a detail view showing the suspension mechanism of a carrier in elevation and other parts of the apparatus in cross section and greatly enlarged in scale by comparison to FIG. 1.

FIG. 2 illustrates the suspension device which enables the decoupling of the carriers 3 from the cable 11 and recoupling of the carriers 3 thereto.

As can be seen from this Figure, the rail 2 is a channel supported by an I-beam 2*a* held on brackets 2*b* of the frame 12. Each carrier 3 is provided with a rolling carriage 33 having rollers 35 guided in the channel forming the rail 2. In addition, the carrier 33 is provided with a clamp 34 having a pair of jaws which can engage the cable 11 and which can be opened and closed by a lever-actuated mechanism only part of which can be seen in FIG. 2. Mechanisms whereby clamps engage and disengage the cable in cable conveyances and in which the mechanism is actuated by a lever are well known in the art and need not be developed in detail herein.

The carriage 33 has a spring-biased lever 31 operating the clamp 34 and formed at a free end of this lever with a roller 32. When the free end of the lever 31 carrying the roller 32 is pressed downwardly, the clamp is disengaged from the cable. When the roller 32 is liberated so as to move upwardly and a cable 11 is located within the clamp, the clamp jaws close so that the carrier can seize the cable and be entrained thereby.

The roller 32 is engageable by a plate 32*a* which can be formed as a ramp on the frame 12 so that as the carriers approach the station and after the wheels 35 engage in the rail 2, the plate 32*a* deflects the roller 32 downwardly and releases the clamp 34, permitting the cable to pass downwardly to the disk 1 and leave the carriages 33 to roll on the rail 32. The carriages 33 also have drive plates 36 visible in both FIG. 2 and in FIGS. 3 and 4, which can be driven by the wheels 4, 5 and 6 to control the speeds of the carriages and hence of the carriers. The plates 32*a* can form part of a guide-rail structure represented at 16 and supported at 16*a* from the framework 12.

Thus, for decoupling of each carrier 3 from the cable 11, its roller 32 is engaged from above by the guide rail 16 to displace the lever 31 against the force of its spring downwardly and spread apart the jaws of the clamp 34 to open the clamp. Analogously, when the carrier 3 is up to speed, the rail 16 can release the roller 32 so that the lever 31 can be swung upwardly by the force of its spring and the clamp 34 automatically closed on the cable 11.

Figure 3:
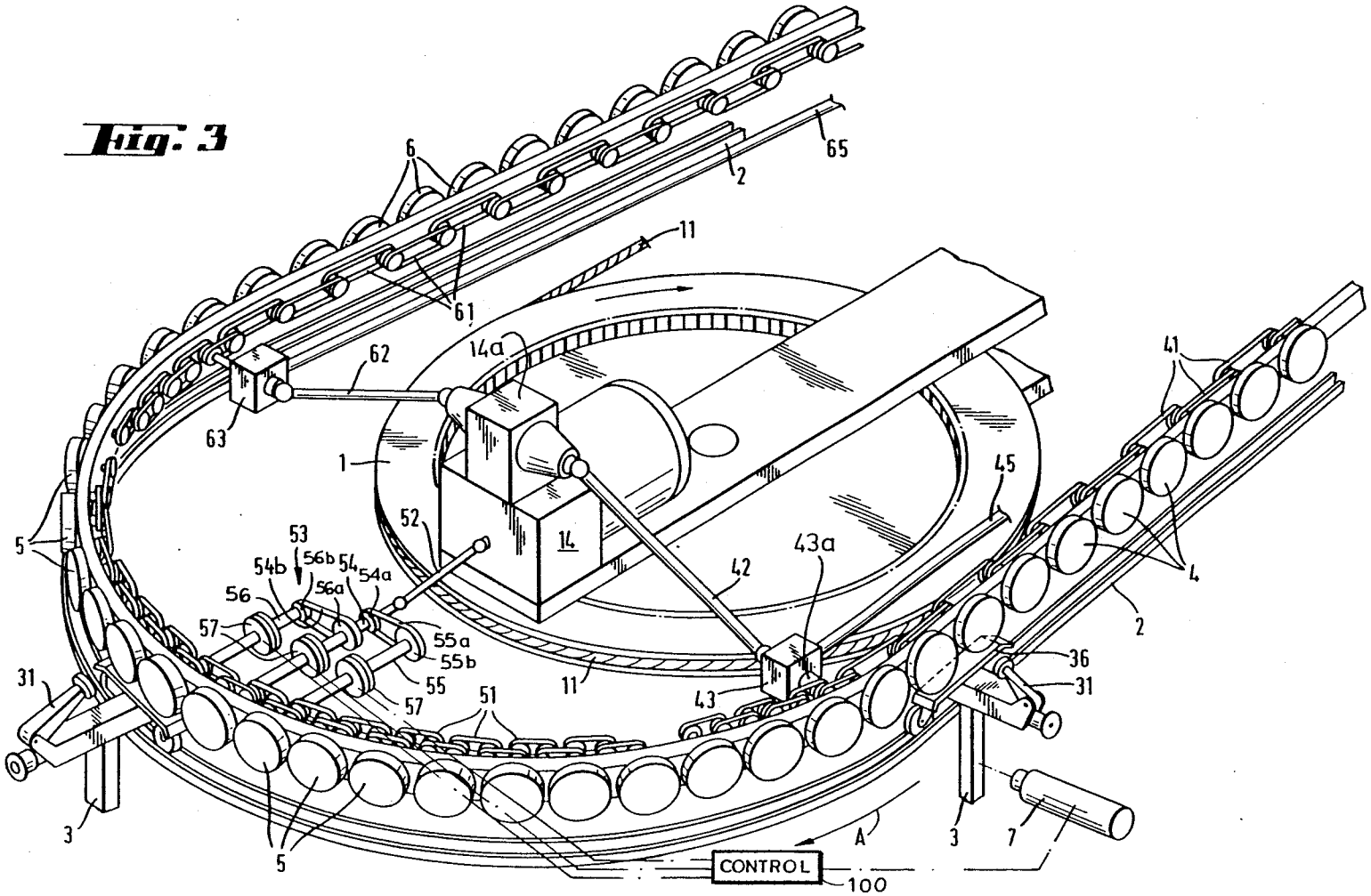
FIG. 3 is an axonometric view of the station shown in FIG. 1 and illustrative of a first embodiment of the invention.

As can be seen from FIG. 3, the rail 2 is located outwardly of the cable disk 1 about which the cable 11 is guided. The carriers 3 are guided in the rail 2 and the rail 2 is associated with the three groups of wheels 4, 5 and 6 which can successively engage the drive plate 36 of the respective carrier 3. Because of this engagement, the carrier 3 is displaced along the rail at speeds equal to the respective peripheral speeds of the rollers 4, 5 and 6 so that the carrier speed is thereby controlled.

To drive the wheels 4, 5 and 6, a motor 14 is provided. The motor 14 is connected by a load-splitting transmission 14*a* and a universal joint shaft 42 with a decelerating transmission 43.

The transmission 43 has a shaft 43*a* driving one of the wheels 4 directly. The remaining wheels 4 are connected to the driven wheel 4 by belt drives 41 which can properly dimension the peripheral speeds of the rollers 4 to bring about the desired reduction in speed of the carriers 3. The first wheels in the group of the wheels 4 can be driven by a takeoff shaft 45 in a manner not shown in detail. The drive via shaft 45 can compensate for slip in the driving of the wheels 4. The wheels 4 form a first group whose drive is so controlled that in the direction of movement A of the carriers 3, the peripheral speed of the wheels 4 progressively is reduced.

The carriers 3 then encounter the following group of wheels 5 which also may, as shown in the embodiment of FIG. 3, all be coupled together by the V-belts and V-belt pulleys as represented at 51.

Furthermore, the drive of the wheels 5 is effected by the motor 14 via a shaft 52 and another transmission represented generally at 53 and capable of producing a plurality of output speeds.

For example, the shaft 52 can have a direct drive shaft 54 connected via one electromagnetic clutch 57 with a respective wheel 5. It also may have driving V-belt pulleys 54*a* and 54*b* connected by V-belts 55*a* and 56*a* to step-down pulley 55*b* and step-up pulley 56*b* respectively mounted on further drive shafts 55 and 56 driven with correspondingly different speeds relative to the shaft 54. The shafts 55 and 56 are connected to the respective wheels 5 by further electromagnetic clutches 57. By selective energization of the electromagnetic couplings 57, one of the three drivable wheels 5 will be rotated at a corresponding speed while the shafts of the other two driving wheels will be decoupled therefrom.

The shaft 54 can thus deliver an average speed to the wheels 5 while the shafts 55 and 56 can deliver respectively a reduced speed and an increased speed.

The final group of wheels 6 is located downstream of the wheels 5 in the direction A in which the carriers 3 are displaced. The wheels 6 are also coupled together by belt drives 61 and are driven, in turn, by a universal joint shaft 62 and yet another transmission 63 coupled to one of the wheels 6. As in the case of the shaft 45, a further shaft 65 connects the transmission 63 to a wheel of the group of wheels 6 close to the end of this group and in the region at which the carriers are recoupled to the cable. Thus the transmission 63 drives one of the wheels 6 directly and the motion is transferred to the remaining wheels via the V-belt drives so that the wheels have progressively increased speed in the direction of movement A, until ultimately the speed is imparted to the carrier which is equal to the speed of the cable.

The shaft 65 likewise serves to compensate for slip in the belt drives 61.

At the region of the last of the wheels 4 forming the decelerating stretch, a measuring device 7 is provided which senses the passage of the carriers 3. The sensor 7 is connected via a controller 100 to the electromagnetic clutches 57 for selectively actuating same.

The cable conveyance of FIG. 3 operates as follows: Upon arrival of a carrier 3 at the station, the carrier is decoupled from the cable 11 in the manner described and guided along the rail 2.

In the decelerating region, the wheels 4 engage the drive plate 36 of the decoupled carrier 3. Since the wheels are successively driven with lesser peripheral speed, the speed of the carrier 3 is thereby reduced. The reduction in speed is effected to reduce the speed to a point that passengers can leave the carrier or can mount the carrier.

The sensor 7 detects the time interval between two successive passes of carriers 3. If the carriers are too close together, the following carrier must have its motion further decelerated. If the carriers are too far apart, the following carrier must be accelerated. If the carriers are separated by an interval corresponding to the desired spacing, the carrier need be neither accelerated nor decelerated. The control 100 thus compares the timing of each carrier pass with a predetermined interval and selectively operates the clutches 57 accordingly. If the carrier does not require acceleration or deceleration to maintain the predetermined spacing, the clutch of shaft 54 is energized and the clutches of shafts 55 and 56 are deenergized. If acceleration of the carrier is required to close an excessive gap, the clutch of shaft 56 is energized and the clutches 57 of shafts 54 and 55 are deenergized. Conversely, if the carrier must be retarded further to increase the gap, the clutch 57 of shaft 55 is energized and the clutches 57 of shafts 54 and 56 remain deenergized.

Thus while the carriers pass along the control stretch of wheels 5, their speeds may be individually adjusted and the adjustment can be simply effected by switching over from one drive shaft to another drive shaft during passage along the control stretch, any errors in spacing between two successive carriers 3 can be corrected.

At the end of the control stretch, the carriers are engaged by the wheel 6 of the acceleration stretch and are uniformly accelerated to the speed of the cable 11, whereupon they are coupled to the cable 11 in the manner already described.

Figure 4:
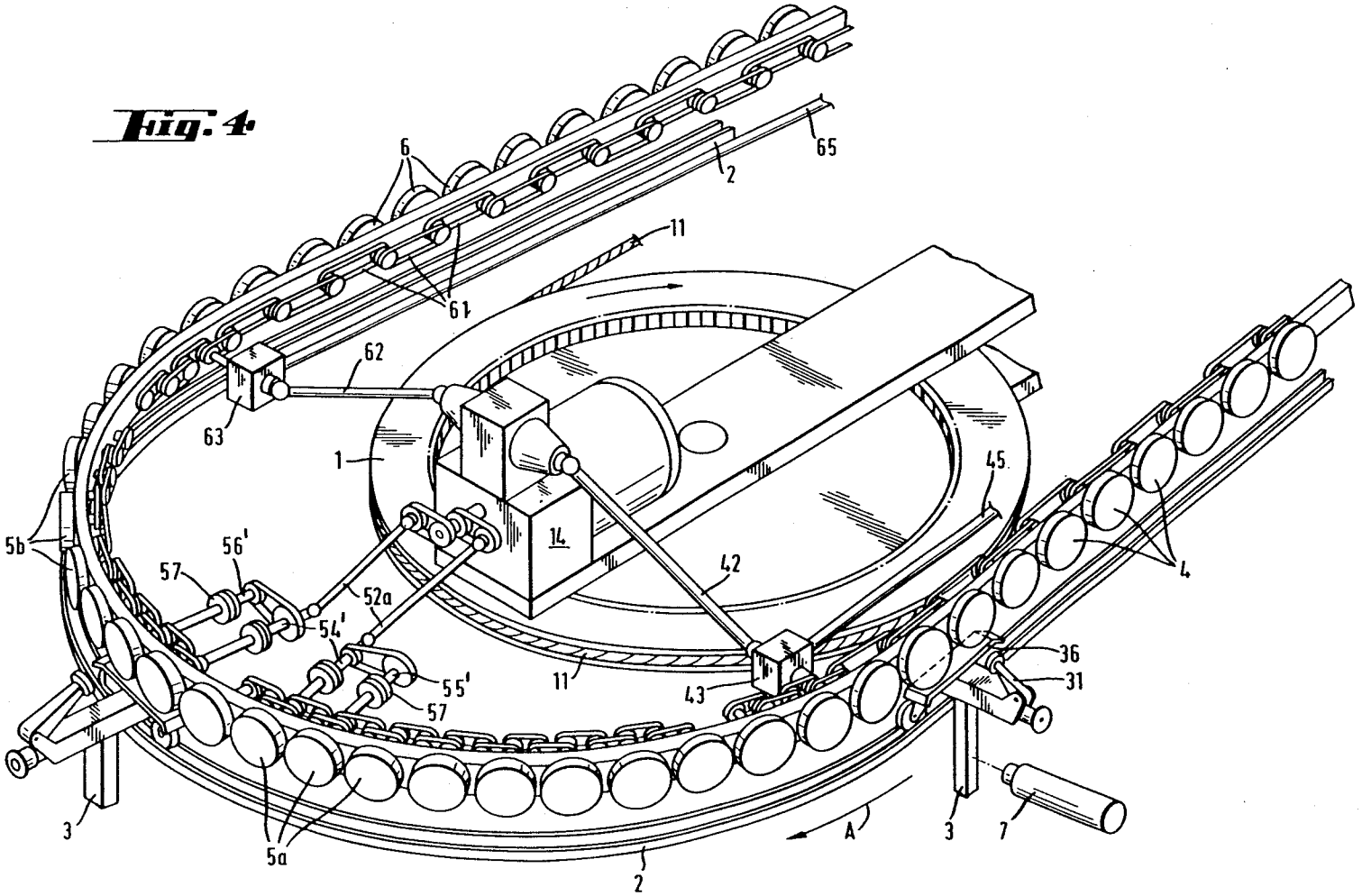
FIG. 4 is a view similar to FIG. 3 of a second embodiment.

FIG. 4 shows a variant on the system of FIG. 3 in which the control stretch has its wheels subdivided into two groups 5*a* and 5*b*. In this system, two universal joint shafts 52*a* driven by the transmission 14 can deliver the normal speed to a wheel of each group via shafts 54' and irrespective magnetic clutches 57. The group 5*a* is also provided with a shaft 55' connected to the shaft 54' by a stepped-down V belt pulley system. The group 5*b* has its other shaft 56' connected to its shaft 54' a step-up V belt transmission. As in the embodiment of FIG. 3 a controller is provided for operation of the electromagnetic clutches 57.

It will be apparent that, in response to the detection of the intervals between passages of the carriers 3, the sensor 7 in this embodiment can operate the wheels 5 of the group 5*a* to drive them with a shaft 54' at normal speed or a shaft 55' with a reduced speed by comparison to the normal speed. Similarly, the wheels of the group 5*b* can be driven either at normal speed or at a speed greater than normal speed. During a passage of a carrier through the control stretch, therefore, no switchboard of the wheels to a different speed of one group is required when the other group engages the carrier and vice versa. This system permits the speeds of one carrier to be increased relative to another carrier in the control stretch or reduced as desired.

Of course, the embodiment of FIG. 4 illustrates as well the principle of subdividing the wheels of the control stretch into a plurality of groups which can be driven at normal speed or at speeds either above or below normal speed so that correction of the spacing of carriers by individually controlling their speeds can be carried out more efficiently. Of course, in accordance with the same principles, a portion of the wheels of the accelerating stretch or of the decelerating stretch can be separately controllable with respect to the other rolls of that stretch for control of the spacing between the carriers.

I claim:

1. A cable conveyance comprising:

a transport cable displaceable between stations;

a plurality of carrier adapted to be affixed to said cable at spaced-apart locations and to be decoupled from said cable; and at least one station at which said carriers are decoupled from and recoupled to said cable, said station being provided with:

a rail supporting said carriers at said station and defining a path for carriers decoupled from said cable from an arriving side of said station to a return side of said station whereby said carriers are decoupled from said cable at an upstream side of said path and are recoupled to said cable at a downstream side of said path, said path being formed with a decelerating stretch at said upstream side and with an accelerating stretch at said downstream side defining a control stretch therebetween, each of said stretches being formed by wheels spaced apart and engageable with said carriers, whereby said carriers are decelerated from a speed of said cable along said decelerating stretch to permit passengers to dismount and passengers to mount said carriers and are accelerated to said speed of said cable along said accelerated stretch;

a sensor along said path of carriers decoupled from said cable responding to a spacing between successive carriers, and drive means along said path for increasing or decreasing the speed of a carrier, said drive means being provided with a controllable drive including:

a transmission provided with a plurality of shafts connected to at least some of the wheels of said control stretch and driven at different speeds and with respective clutches operatively driving said wheels of said control stretch from the respective shafts, said controllable drive enabling individual carriers to be accelerated or decelerated with respect to a normal speed of travel of said carriers through said control stretch in response to said sensor to vary the spacing of said carriers along said path and control the spacing of carriers as the carriers are recoupled to said cable.

2. The cable conveyance defined in claim 1 wherein said drive means is connected to at least one of said stretches.

3. The cable conveyance defined in claim 1 wherein said sensor is provided at a downstream end of said decelerating stretch.

4. The cable conveyance defined in claim 1 wherein said sensor is responsive to a time interval between successive passes of said carriers.

5. The cable conveyance defined in claim 1 wherein all of said control stretches are coupled together for joint rotation and said transmission is provided with means for selectively applying respective speeds to at least one of the wheels of said control stretch.

6. The cable conveyance defined in claim 1 wherein the wheels of said control stretch are divided into respective groups of said transmission as respective drive outputs selectively driving said groups at different speeds in response to said sensor.

7. A cable conveyance comprising:

a transport cable displaceable between stations;

a plurality of carriers adapted to be affixed to said cable at spaced-apart locations and to be decoupled from said cable; and at least one station at which said carriers are decoupled from and recoupled to said cable, said station being provided with:

means at said station defining a path for carriers decoupled from said cable from an arriving side of said station to a return side of said station whereby said carriers are decoupled from said cable at an upstream side of said path and are recoupled to said cable at a downstream side of said path, said path being formed with a decelerating stretch at said upstream side and with an accelerating stretch at said downstream side defining a control stretch therebetween, said control stretch having a plurality of wheels successively engageable with said carrier and spaced along said control stretch;

a sensor along said path of carriers decoupled from said cable responding to a spacing between successive carriers, and drive means along said path for controlling the speed of a carrier along said path, said drive means being provided with a plurality of shafts connected to respective wheels of said control stretch and driven at different speeds and respective clutches operatively driving said wheels of said control stretch from the respective shafts.

8. The cable conveyance defined in claim 7 wherein said control stretch is formed by two groups of the wheels, each of said groups being drive by a respective shaft.

* * * * *